US008214976B2

(12) United States Patent
Tao et al.

(10) Patent No.: US 8,214,976 B2
(45) Date of Patent: Jul. 10, 2012

(54) METHOD AND APPARATUS FOR PILLING REDUCTION

(76) Inventors: Xiaoming Tao, Kowloon (HK); Wai Man Li, Kowloon (HK); Bingang Xu, Kowloon (KH); Kok Keung Lo, Kowloon (HK)

( * ) Notice: Subject to any disclaimer, the term of this patent is extended or adjusted under 35 U.S.C. 154(b) by 460 days.

(21) Appl. No.: 12/453,076

(22) Filed: Apr. 29, 2009

(65) Prior Publication Data

US 2010/0275421 A1 Nov. 4, 2010

(51) Int. Cl.
*D06C 13/00* (2006.01)

(52) U.S. Cl. ..... 26/15 R; 26/27; 26/29 R; 26/29 P

(58) Field of Classification Search ..... 26/15 R, 26/7, 11, 12, 29 R, 27, 29 P, 1, 15 FB, 37; 15/111, 104.001, 309.1, 88.3, 308, 344, 366, 15/383, 105; 223/18, 19, 66, 67
See application file for complete search history.

(56) References Cited

U.S. PATENT DOCUMENTS 1,600,571 A * 9/1926 Zabel ..... 26/15 R
1,742,829 A * 1/1930 Schreiber ..... 26/29 P
1,752,611 A * 4/1930 Naumann ..... 26/11
1,868,170 A * 7/1932 Jasgur ..... 38/75
1,979,030 A * 10/1934 Friedman ..... 69/20
2,149,886 A * 3/1939 Hadley ..... 26/15 R
2,695,438 A * 11/1954 Bejeuhr ..... 26/17
3,077,654 A * 2/1963 Hadley et al. ..... 26/15 R
3,267,548 A * 8/1966 Hadley ..... 26/15 R
3,351,990 A * 11/1967 Schuster ..... 26/15 R
3,363,276 A * 1/1968 Thomas, Jr. ..... 15/105
4,649,606 A * 3/1987 Fay ..... 26/15 R
4,882,818 A * 11/1989 Weathers et al. ..... 26/15 R
4,985,999 A * 1/1991 Iwasaki et al. ..... 30/206
5,077,856 A * 1/1992 Freundl ..... 15/104.002
5,557,039 A 9/1996 Annis et al.
5,575,031 A * 11/1996 Chai ..... 15/111
5,623,745 A * 4/1997 Stanek ..... 15/339
6,051,034 A 4/2000 Caldwell
6,430,787 B1 * 8/2002 Becan et al. ..... 26/16
2002/0148083 A1 * 10/2002 Langius et al. ..... 26/29 R

OTHER PUBLICATIONS

Bahi, A., Jones, J.T., Carr, C.M., Ulijn, R.V., & Shao, J. (2007). Surface characterization of chemically modified wool. Textile Research Journal, 77(12), 937-945.
Chikkodi, S.V., Khan, S., & Mehta, R.D. (1995). Effects of biofinishing on cotton/wool blended fabrics. Textile Research Journal, 65(10), 564-569.
Conti, W., & Tassinari, E. (1974). Simplified kinetic model for the mechanism of pilling. Journal of the Textile Institute, 65(3), 119-125.
Cooke, W.D. (1984). Fibre fatigue and the pilling cycle, Part 3:Pill wear-off and fibre attrition. Journal of the Textile Institute, 75(3), 201-211.

(Continued)

*Primary Examiner* — Amy Vanatta
(74) *Attorney, Agent, or Firm* — The Hong Kong Polytechnic University

(57) ABSTRACT

An apparatus for reducing pilling on a piece of garment/fabric includes at least one holding member adapted to secure the piece of garment/fabric, a rotatable brush member adapted to brush on the piece of garment/fabric until loose fibers of the garment/fabric migrates to a surface of the garment/fabric to form a layer of pillable fuzz, a shaving member adapted to remove the layer of pillable fuzz on the piece of garment/fabric, and a control unit adapted to control movement of the rotatable brush member and the shaving member.

11 Claims, 6 Drawing Sheets

OTHER PUBLICATIONS

Fintis, D., & Mead, E.J. (1959). The mechanism of pilling. Textile Research Journal, 29(7), 578-585.
Omura, Y., Wakayama, K., & Inour, T. (1969). Pilling on wool fibres. Journal of the Textile Machinery Society of Japan, 21(2), 45-53.
Schindler, W.D. (2004). Chemical Finishing of Textiles. Cambridge, England: Woodhead Publishing in Textiles.
Stryckman, J., & Leclereq, F. (1973a). Methods and finishes for reducing pilling Part 1 Wool Science Review, 42, 32-45.
Stryckman, J., & Leclereq, F. (1973b). Methods and finishes for reducing pilling Part 2 Wool Science Review, 43, 26-32.
Ukponmwan, J.O., Mukhopadhyay, A., & Chatterjee, K.N. (1998). Pilling. Manchester, UK: The Textile Institute.

* cited by examiner

METHOD AND APPARATUS FOR PILLING REDUCTION

BACKGROUND OF THE INVENTION

1. Field of the Invention

The present invention is related to a method and apparatus for pilling reduction on garments and fabrics.

2. Description of the Related Art

Pilling has been a quality problem for fabrics and garments. Over the years, many anti-pilling treatments have been developed to increase the pilling resistance to fabrics. Generally, these treatments can be classified into three categories, namely physical, chemical and biochemical methods.

In general, two approaches have been taken to prevent pills from accumulating on fabric surfaces. The first approach is to inhibit the formation of pills. This can be achieved by removing protruding fibers using physical and biochemical methods or bind the fibers into the fabric surface using chemical method. The second approach is to make the pills fall off the fabrics as soon as they are formed. This can be accomplished by chemically reducing the fiber strength.

Most of those physical treatments commonly used, such as shearing and cropping, are only applicable to smooth-faced fabrics but not suitable for irregular knitted fabrics. Although many effective chemical treatments are currently available, the properties of the fabrics might be adversely affected by the chemical used. Moreover, the foregoing treatments may cause degradation of wool's natural moisture transmission properties, one of wool's strength. In most cases, chemical is also harmful to the environment. Although biochemical treatments of using enzymes are effective and environmentally friendly, the process is often complicated and time consuming.

There exists a need for a pilling reduction process that does not use or discharge any waste water, steam or chemicals or enzymes in which the treatment does not affect color, bursting strength; thermal insulation property and fabric handling of the treated fabrics or garments.

SUMMARY OF THE INVENTION

According to an aspect of the present invention, an apparatus for reducing pilling on a piece of garment/fabric includes at least one holding member adapted to secure the piece of garment/fabric, a rotatable brush member adapted to brush on the piece of garment/fabric until fibres in the garment/fabric migrate to the surface of the garment/fabric to form a layer of pillable fuzz, a shaving member adapted to remove the layer of pillable fuzz on the piece of garment/fabric, and a control unit adapted to control movement of the rotatable brush member and the shaving member.

According to another aspect of the present invention, a method for reducing pilling on a piece of fabric, the method includes securing the piece of fabric on a table, accelerating fuzz generation of the piece of fabric by mechanical agitation of the piece of garment until fibres in the fabrics migrate to the surface of the piece of fabric to form a layer of pillable fuzz, and removing the layer of pillable fuzz on the piece of fabric.

Further features and aspects of the present invention will become apparent from the following description of exemplary embodiments with reference to the attached drawings.

DESCRIPTION OF THE EMBODIMENTS

The root of the pilling is the existence of entanglement of pillable fuzz on fabric surface. The pillable fuzz is limited in supply and it tends to migrate from inside the fabric to the surface during wear and testing. The present invention is related to a processing method that artificially accelerating the fuzz generation and reducing the amount of pillable fuzz on the fabric or garment. For the sake of simplicity, while not necessarily identical, the terms fabrics and garments often are used interchangeably throughout this specification.

Figure 1:
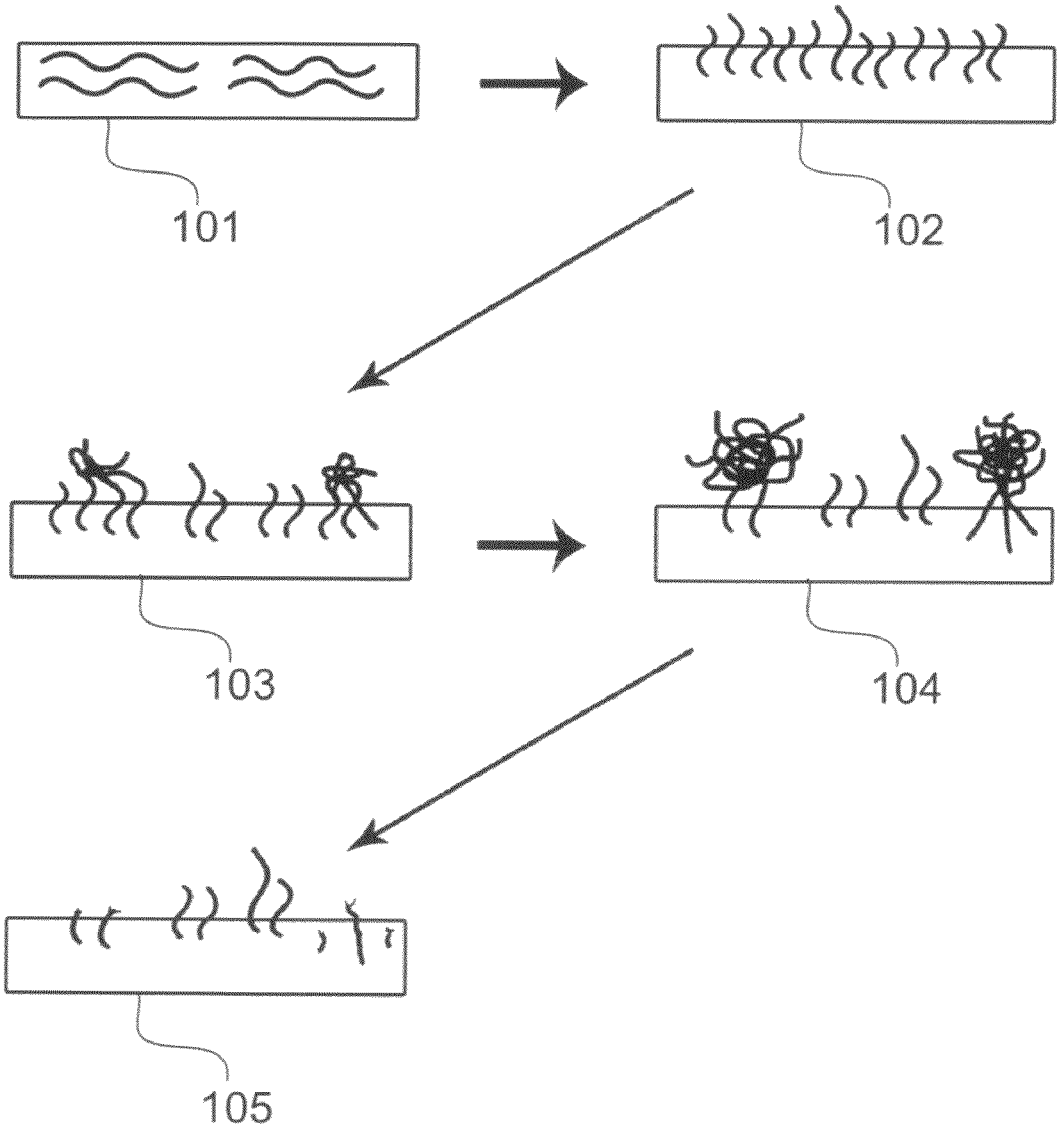
FIG. 1 illustrates a general scenario of the stages of pilling.

FIG. 1 is a diagram illustrating various stages of pilling. In a first stage of fuzz generation, through abrasion, loose fibres (101) are pulled to the fabric surface and formed a layer of 'fuzz' (102). In a second stage of pills formation, the loose fibres are then entangled by the applied abrasion to form pills (103). As the abrasion continues (104), the anchor fibres are eventually broken and the pills break off (105) in a third stage. When the rate of pill formation and the rate of pill break off are equal, an equilibrium state exists. When abrasion lasts long enough, the source of loose fibres becomes exhausted, the rate of pill formation decreases and the total number of pills decreases.

The pilling reduction process according to an embodiment of the present invention involves accelerating fuzz formation as the first step of the pilling formation, in which the potential pillable fuzz migrates to the fabric surface by a number of methods, such as tumbling, abrasion or brushing. Then, the process follows by a second step of removing the generated fuzz layer by fire singeing, laser singeing or shaving.

Prior to the acceleration of fuzz formation, the piece of fabric may undergo a pre-treatment process to allow the pillable fuzz to easily migrate to the fabric surface. More specifically, the fabric is pre-treated by steaming to reduce the internal stress of the yarns and air suction was applied to cool down the steamed fabrics and remove extra moisture.

When the fabric surface is treated by mechanical actions, such as tumbling, flat abrasion or brushing action, frictional force will be applied on those fibres on the fabrics surface. This force can be resolved into two components, one along the fibre axis and the other perpendicular to the fibre axis. The axial force will tend to drag the fibre out of the fabric surface, but the axial force cannot produce the movement of the fibre into the fabric as the fibre will not maintain this axial compressive forces. If the frictional force is greater than the cohesive force between the fibres, then the fibres will migrate to the surface. As there is a tendency of migration of the fibres inside the fabric, broken fibre and those with lower rigidity will migrate to the surface and from fuzz. The fuzz is regarded as pillable fuzz, which can form pills if further mechanical action applied. This first part of the whole treatment attempts to make the pillable fuzz come out to the fabric surface as much as possible, so that a larger amount of pillable fuzz can be removed in the later process.

Figure 2:
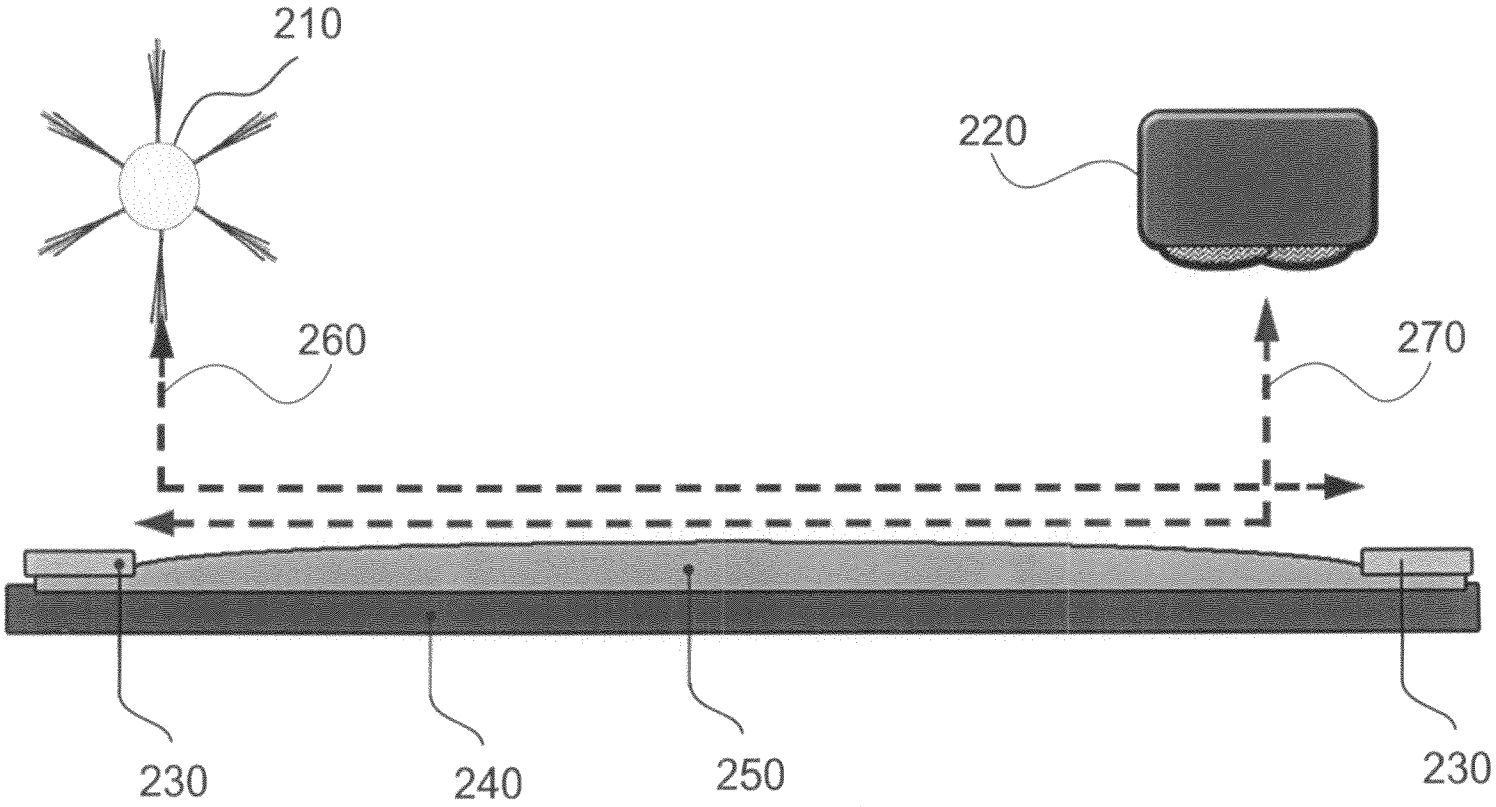
FIG. 2 illustrates an exemplary pilling reduction apparatus according to an embodiment of the present invention.

The acceleration of fuzz generation can be achieved by using mechanical methods. FIG. 2 illustrates an exemplary configuration of a pill reduction apparatus. The present invention reduces the amount of pillable fuzz on fabric and garment by artificially accelerating fuzz generation and removal of fuzz pills layer.

Next, removal of fuzz and pills is performed. The generated fuzz and pills layer can be physically removed by lint shavers, singeing devices using flame or laser. The height of the fuzz should be shortened below the critical pillable height as indicated, for example, in the table below:

| Fiber | Critical Height (1/32 in.) |
|---|---|
| Vicara | 11 |
| Acetate | 10 |
| Wool, 64-70's | 10 |
| Orlon | 10 |
| Rayon | 9 |
| Nylon | 9 |
| "Dacron" (Ribbon) | 9 |
| "Dacron" (Round) | 7 |
| Cotton, St. Vincent (1.1 den./fil.) | 6 |

The above table is provided by Gintis, D., and Mead, E. J. (1959), "*The mechanism of pilling, Textile Research Journal*", which indicates the critical height of entanglement tendency for various types of textile fibres. After the foregoing processes, the amount of pillable fuzz can be significantly reduced.

The apparatus of FIG. 2 includes a table (flat surface) 240 with a non-slippage and soft surface, a piece of fabric 250, fabrics holding members 230, a rotatable brush member 210, and a precision cutting/shaving panel 220.

The table 240 includes holding members 230, which may be a clip or the like that secures the piece of fabric 250. The rotatable brush member 210 is capable of coming into contact with the piece of fabric/garment and performing the brushing action. The rotatable brush member 210 will be described in more details below in connection with FIGS. 3B and 3C.

When a piece of fabric is placed on the table and secured by the holding member, the rotatable brush member 210 begins its rotation for brushing by an electric motor. Then, the rotatable brush member comes into contact with the fabric/garment and performs the acceleration of fuzz generation by brushing the fabric/garment in a lateral direction path (260). The brushing action continues for a number of times until the majority of loose fibres migrate to the surface of the fabric/garment and form a layer of pillable fuzz. Depending on the type of fabric/garment, the brushing action may be performed with different pressure and time duration. As a result of the brushing action, a layer of pillable fuzz is formed on the surface of the fabric/garment.

Subsequently, the precision cutting/shaving panel 220 begins the attrition process by shaving off the layer of pillable fuzz. Similar to the brushing action, the precision cutting/shaving panel 220 performs shaving along a lateral direction (270). The cutting/shaving panel moves back and forth along path 270 for a predetermined number of times until the layer of pillable fuzz is shaved off from the piece of garment.

Figure 3A:
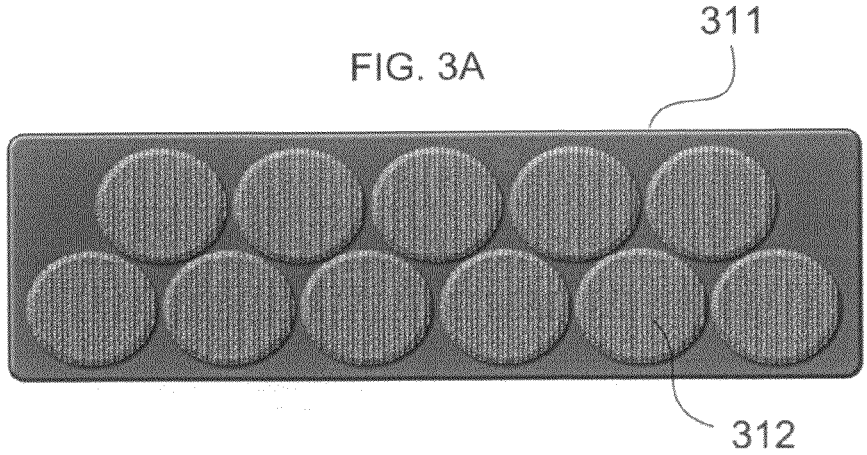
FIG. 3A illustrates a cutting/shaving head panel with pivot cutting heads.

The exemplary precision cutting/shaving panel 311 is illustrated in FIG. 3A. The precision cutting/shaving panel 311 includes a plurality of flexible shaving heads 312 that are capable of pivoting to enable closer shaving at various angles. The pivot cutting heads 312 allow fuzz and pills to penetrate through its holes and shave by the shaver. Precision cutting/shaving panel 311 may also include an air suction unit (not shown) that clear the fibres trapped inside the shaver.

In another embodiment, the rotatable brush member 210 is held stationary while the table 240 moves along a horizontal direction to perform brushing action across the entire surface of the piece of fabric. In this embodiment, the table 240 is driven by an electric motor to move in a horizontal direction.

Figure 3B:
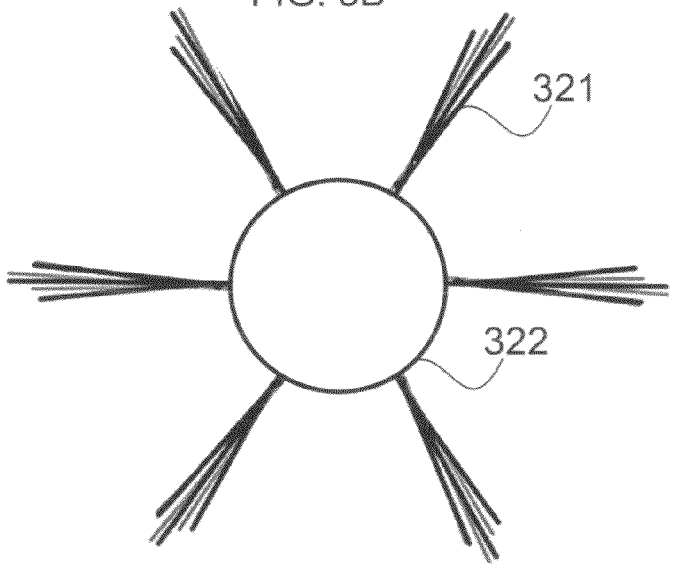
FIGS. 3B and 3C illustrate a cross-sectional and longitudinal view of the rotatable brush member.
Figure 3C:
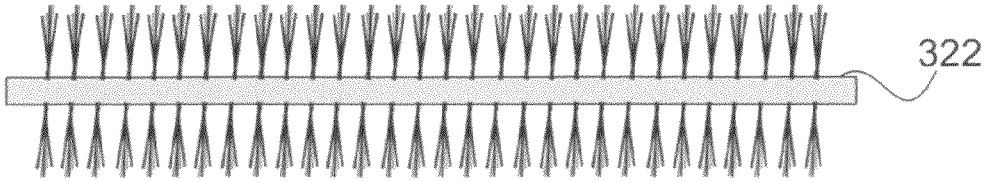

The exemplary structure of the rotatable brush member 210 is illustrated in FIGS. 3B and 3C. FIGS. 3B and 3C show a cross-sectional and longitudinal view of the rotatable brush member 210, respectively. The center of the rotatable brush member is a metal rod 322 attached with brush bristles 321. The brush bristles 321 may have different length, bending rigidity, shapes of ends and anti-static properties. Rotatable brush member 210 may also include an air suction unit (not shown) inside the metal rod 322 to clear the fibres trapped in the rotatable brush member. The density and rigidity of the brush's bristles may also be adjustable depending on the type of fabric/garment.

In response to the abrasion process performed by the rotatable brush member, broken fibres will migrate to the surface of the fabric/garment. By repeating the process of abrasion, a layer of pillable fuzz may rise to the surface of the piece of fabric/garment. Then, a shaver, such as a lint shaver, may be used to remove the layer of pillable fuzz on the surface of the piece of fabric/garment. The shaver shaves along the direction (270) as indicated in FIG. 2, hence, the layer of pillable fuzz can be removed. The precision cutting/shaving panel 220 may also include an air-suction unit for clearing the fibres trapped in the precision cutting/shaving panel 220.

Figure 4A:
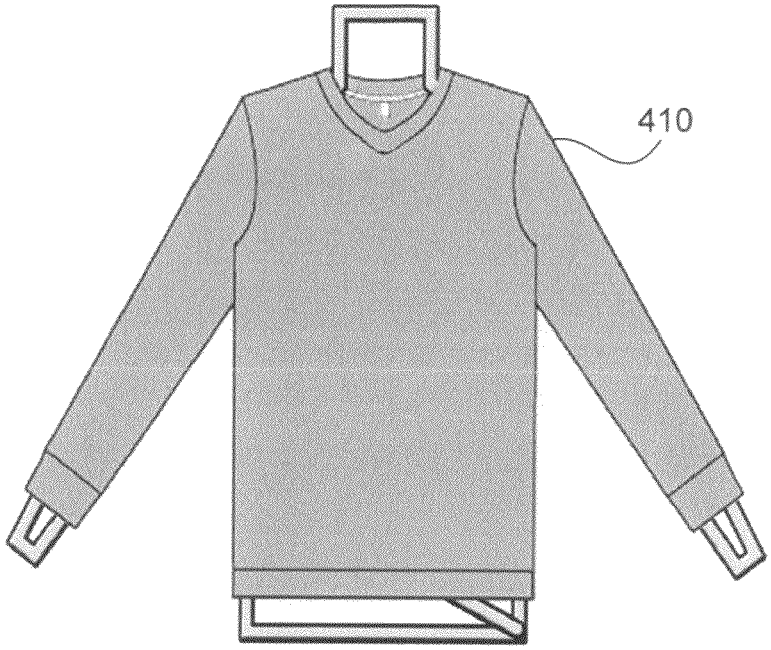
FIGS. 4A and 4B illustrate an exemplary garment/fabric holder using an expandable elastic stick garment/fabric holder according to an embodiment of the present invention.
Figure 4B:
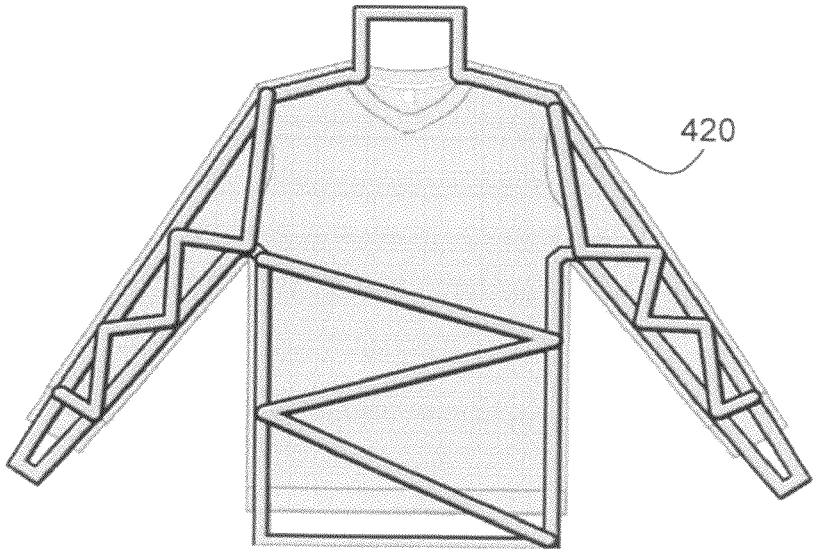

In addition to placing the garment on a table (or a flat surface), a special garment holder may also be utilized. As shown in FIGS. 4A and 4B, an expandable garment holder is inserted inside a sweater 410. The elastic stick holder 420, which may be two or three-dimensional, is adjustable and expandable to fit with the sweater as shown in FIG. 4B. Then, the sweater with the elastic stick holder 420 is placed on table 240 for the brushing and shaving processes.

Figure 5:
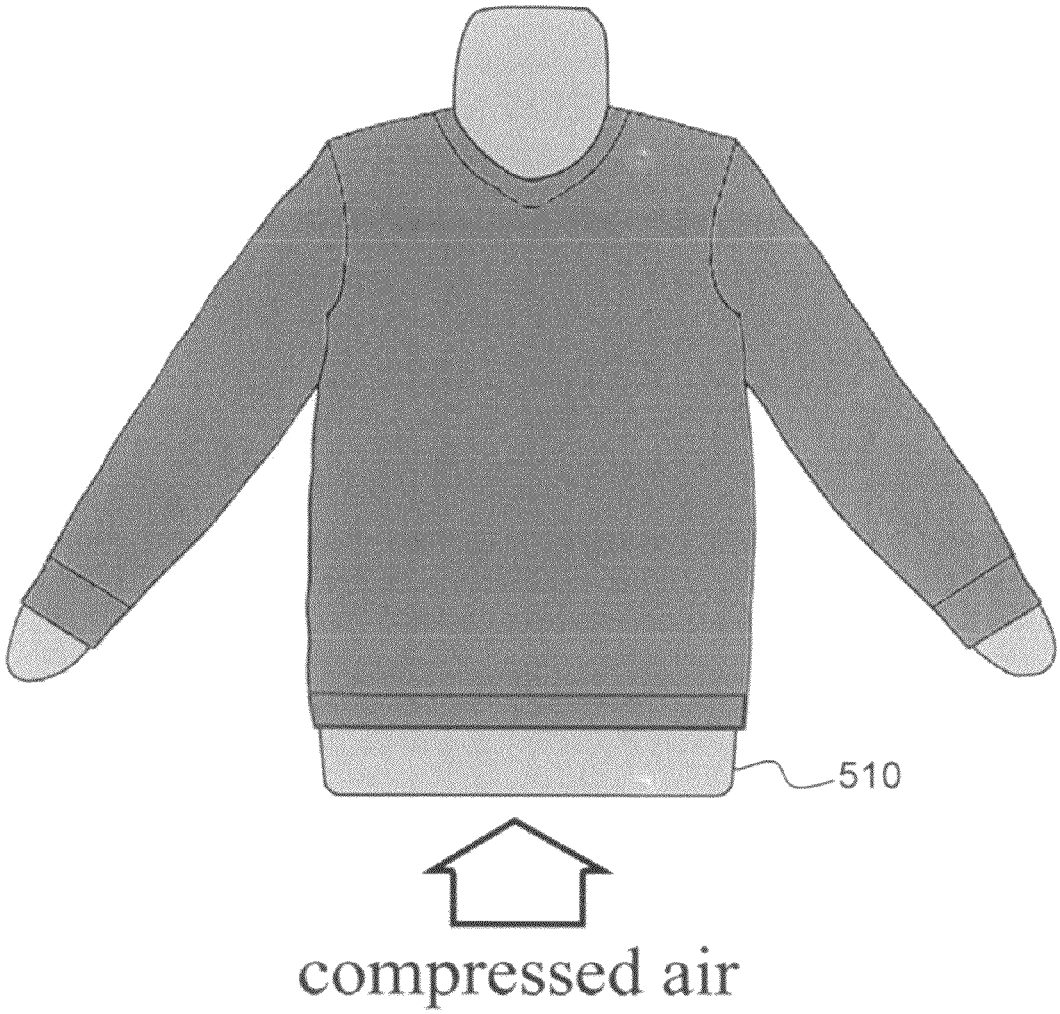
FIG. 5 illustrates an exemplary garment/fabric holder using expandable airtight membrane according to an embodiment of the present invention.

In another embodiment, the rotatable brush member 210 and precision cutting/shaving panel 220 are attached to a robotic arm so that the rotatable brush member 210 and the precision cutting/shaving panel 220 can move more freely in all directions. Also, the fabric/garment can be placed on a three-dimensional expandable garment holder. As illustrated in FIG. 5, for example, the sweater is inserted with a three-dimensional airtight membrane 510 such as a rubber form. Next, when compressed air is injected into the airtight membrane 510, the airtight membrane 510 expands so that it is in contact (fitted) with the sweater. The airtight membrane 510 can hold the piece of garment in place during brushing and shaving, and thus, a more effective pilling reduction process can be achieved.

Figure 6:
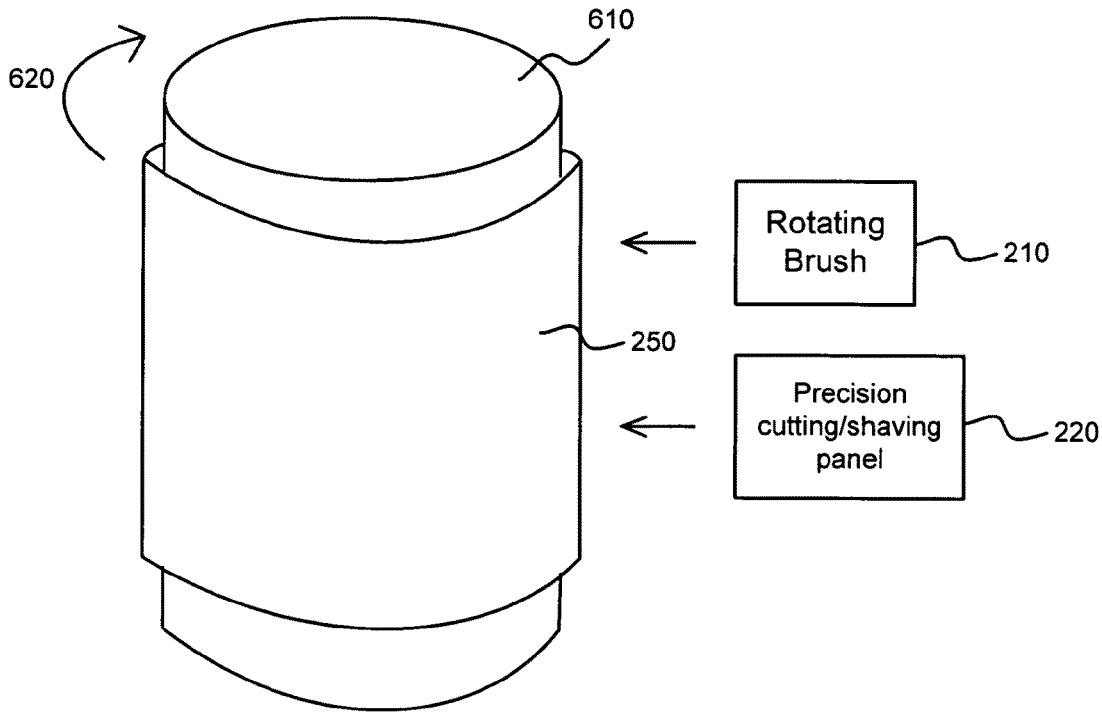
FIG. 6 illustrates an exemplary pilling reduction apparatus according to an embodiment of the present invention.

FIG. 6 illustrates a rotatable tubular garment/fabric holder 610 that is provided to hold the piece of garment/fabric. In this embodiment, the piece of garment/fabric 250 is secured on a circular surface of the tubular garment/fabric holder as shown in FIG. 6. As such, the tubular garment/fabric holder is capable rotating in a direction as indicated in 620 by an electric motor or the like. Due to the circular structure of the tubular holder, brushing action and the removal of the pillable fuzz can be performed continuously by rotating the tubular garment/fabric holder 610 in a single direction.

The present invention includes a control unit (not shown) that controls the movement of the rotatable brush and shaver, and the movement of the rotatable brush and shaver relative to the piece of garment/fabric. Also, it controls the amount of pressure that the rotatable brush presses against the garment/fabric while performing the brushing action, the control unit controls the power and duration of the brushing action. Furthermore, position sensors (not shown) may also be included to provide positioning information of the garment/fabrics to the control device. By utilizing sensors, the position and the type of the garment/fabric can be detected. Thus, the detected information can be used to operate the pilling reduction apparatus.

A computer-executable program code of the control unit to control the foregoing pill reduction process can be encoded in a memory unit such as a computer-readable storage medium.

The present invention significantly reduces the pilling tendency of woven and knitted fabrics as well garments. It is a pure physical process and does not use or discharge any waste water, steam or chemicals or enzymes. The treatment does not affect color, bursting strength, thermal insulation property and fabric handle of the treated fabrics or garments. Furthermore, the invention is applicable to any type of fibers and blends, or any type of yarn.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An apparatus for reducing pilling on a piece of garment or fabric, comprising:

at least one holding member adapted to secure the piece of garment or fabric;

a rotatable brush member adapted to exert pressure, and brush, repeatedly, on the piece of garment or fabric until loose fibres of the garment or fabric migrate to a surface of the garment or fabric to form a layer of pillable fuzz;

a shaving member adapted to remove the layer of pillable fuzz on the piece of garment or fabric; and a control unit adapted to control movement of the rotatable brush member and the shaving member.

2. The apparatus according to claim 1, further comprising:

an expandable garment or fabric holder adapted to be inserted in the piece of garment or fabric.

3. The apparatus according to claim 2, wherein the expandable garment or fabric holder is an elastic stick holder.

4. The apparatus according to claim 2, wherein the expandable garment or fabric holder is made of airtight membranes that is expandable by compressed air.

5. The apparatus according to claim 2, wherein the rotatable brush member and the shaving member is attached with robotic arms to enable brushing and shaving in all directions.

6. The apparatus according to claim 1, wherein the piece of garment or fabric is placed on a movable table that is capable of moving laterally to perform brushing by the rotatable brush member and shaving by the shaving member.

7. The apparatus according to claim 1, further comprises a rotatable tubular garment or fabric holder adapted to hold and secure the garment or fabric, wherein the piece of garment or fabric rotates continuously with the rotatable tubular garment or fabric holder to repeatedly perform brushing by the rotatable brush member, and shaving by the shaving member.

8. The apparatus according to claim 1, wherein the rotatable brush member and the shaving member each contains an air suction unit adapted to clear trapped fibres.

9. The apparatus according to claim 1, wherein the rotatable brush member includes brush bristles, wherein the brush bristles have specific density, length, rigidity, and shape of ends, depending on type of the garment or fabric.

10. The apparatus according to claim 1, further comprises position sensors configured to detect position of the piece of garment or fabric.

11. The apparatus according to claim 1, wherein the shaving member includes a plurality of flexible shaving heads that are capable of pivoting based on the surface of the garment or fabric surface.

* * * * *